US005725322A

United States Patent [19]

Evans

[11] Patent Number: 5,725,322

[45] Date of Patent: Mar. 10, 1998

[54] EAVES TROUGH CLEANER

[76] Inventor: Edward C. Evans, 5314 42nd Ave., Red Deer, Alberta, Canada, T4N-3A4

[21] Appl. No.: 701,637

[22] Filed: Aug. 22, 1996

[51] Int. Cl.[6] ..... A47L 13/03

[52] U.S. Cl. ..... 401/42; 239/532; 401/137; 401/139; 401/289

[58] Field of Search ..... 401/137, 42, 43, 401/46, 139, 289; 15/236.04; 239/532

[56] References Cited

U.S. PATENT DOCUMENTS

| | | | |
|---|---|---|---|
| 2,006,289 | 6/1935 | Andvig | 401/42 |
| 2,910,711 | 11/1959 | Mizelle | 401/139 X |
| 3,023,971 | 3/1962 | Milhous | 15/236.04 X |
| 4,303,348 | 12/1981 | O'Brien | 401/289 X |
| 4,319,851 | 3/1982 | Arthur | 401/139 X |
| 4,750,883 | 6/1988 | Drake | 401/139 X |

FOREIGN PATENT DOCUMENTS

| | | | |
|---|---|---|---|
| 278014 | 12/1966 | Australia | 401/139 |
| 509698 | 3/1952 | Belgium | 401/46 |

*Primary Examiner*—Steven A. Bratlie

[57] ABSTRACT

An eaves trough cleaner including a fluid flow mechanism. The fluid flow mechanism has a top end and a bottom end and an intermediate portion with a cross tubing integral therewith. The cross tubing has an internal fluid passage and a second end with a container coupled. The internal passage has a vertical extension coupled to an elongated tube positionable within the container. Included is a trigger mechanism with a regulator valve coupled to the intermediate portion and spaced from the cross tubing. Also, a cleaning tool is provided. Lastly, at least one connector pipe member is included. The one connector pipe member has an upper end and a bottom end. The bottom end of the pipe member couples with the fluid flow mechanism. The upper end of the pipe member couples with the cleaning tool for placement of the cleaning tool within the eaves trough.

1 Claim, 5 Drawing Sheets

EAVES TROUGH CLEANER

BACKGROUND OF THE INVENTION

1. Field of the Invention

The present invention relates to a eaves trough cleaner and more particularly pertains to providing a device for use in cleaning eaves trough with a controlled amount of water and cleaning solution flowing from the fluid flow mechanism and exiting the cleaning tool into the eaves trough.

2. Description of the Prior Art

The use of a gutter cleaning tool is known in the prior art. More specifically, gutter cleaning tools heretofore devised and utilized for the purpose of removing debris are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,390,853 to Ellul discloses a gutter cleaning tool and system. U.S. Pat. No. 5,435,612 to Kreiser discloses an eaves trough cleaner. U.S. Pat. No. 4,750,883 to Drake discloses a device for cleaning rain gutters. U.S. Pat. No. 4,602,460 to Langenbach discloses a water powered gutter and downspout cleaning apparatus. Lastly, U.S. Pat. Des. No. 267,357 to Hillstrom discloses a gutter cleaning tool.

While these devices fulfill their respective, particular objectives and requirements, the aforementioned patents do not describe eaves trough cleaner that allows easy cleaning of the eaves trough or rain gutters by positioning the cleaning tool within the eaves trough, and allowing a pressurized mixture of water and cleaning solution to be applied.

In this respect, the eaves trough cleaner according to the present invention substantially departs from the conventional concepts and designs of the prior art, and in doing so provides an apparatus primarily developed for the purpose of providing a device for use in cleaning eaves trough with a controlled amount of water and cleaning solution flowing from the fluid flow mechanism and exiting the cleaning tool into the eaves trough.

Therefore, it can be appreciated that there exists a continuing need for a new and improved eaves trough cleaner which can be used for providing a device for use in cleaning eaves trough with a controlled amount of water and cleaning solution flowing from the fluid flow mechanism and exiting the cleaning tool into the eaves trough. In this regard, the present invention substantially fulfills this need.

SUMMARY OF THE INVENTION

In view of the foregoing disadvantages inherent in the known types of gutter cleaning tools now present in the prior art, the present invention provides an improved eaves trough cleaner. As such, the general purpose of the present invention, which will be described subsequently in greater detail, is to provide a new and improved eaves trough cleaner and method which has all the advantages of the prior art and none of the disadvantages.

To attain this, the present invention essentially comprises a fluid flow mechanism. The fluid flow mechanism has a top end and a bottom end and an intermediate portion. The top end has a top connector that is threaded. The bottom end has a bottom connector that is threaded for coupling with a hose. The intermediate portion has a cross tubing integral therewith and spaced from the top end. The cross tubing has a first end, a second end and an internal fluid passage therebetween. The second end of the cross tubing has a container that is coupled. The internal passage has a vertical extension at the second end of the cross tubing. The vertical extension is coupled with an elongated flexible tube that is positioned within the container. Also, a trigger mechanism is coupled with the intermediate portion. The trigger mechanism is positioned between the cross tubing and the bottom end. The trigger mechanism is pivotally coupled with a regulator valve that has a resilient member. The regulator valve controls water flowing through the fluid flow mechanism when the trigger mechanism is pivoted for urging the regulator valve. Additionally, a turn valve mechanism is positioned within the first end of the cross tubing. The turn valve is used for sealing and unsealing the internal passage. A cleaning tool that has a generally J-hook structure is provided. The cleaning tool has a fluid release end and a coupling end with an internal threaded portion. The cleaning tool has a nozzle, with a plurality of holes, that is attached to the fluid release end. Lastly, a pair of elongated connector pipes are included. Each pipe has an upper end and a bottom end. The pair of pipes form a first pipe member and a second pipe member. The bottom end of the first pipe member is releasable coupled with the upper end of the second pipe member. The upper end of the first pipe is capable of coupling with the coupling end of the cleaning tool and allows the cleaning tool to be places within the eaves trough. The bottom end of the second pipe member is capable of coupling with the top end of the fluid flow mechanism when the first pipe is coupled to the cleaning tool. Whereby, when the fluid flow mechanism is coupled to the hose the trigger mechanism allows water to flow through the pair of elongated connector pipes for release through the nozzle of the cleaning tool within the eaves trough.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved eaves trough cleaner which has all of the advantages of the prior art gutter cleaning tools and none of the disadvantages.

It is another object of the present invention to provide a new and improved eaves trough cleaner which may be easily and efficiently manufactured and marketed.

It is further object of the present invention to provide a new and improved eaves trough cleaner which is of durable and reliable constructions.

An even further object of the present invention is to provide a new and improved eaves trough cleaner which is susceptible of a low cost of manufacture with regard to both materials and labor, and which accordingly is then susceptible of low prices of sale to the consuming public, thereby making such eaves trough cleaner economically available to the buying public.

Even still another object of the present invention is to provide a eaves trough cleaner for providing a device for use in cleaning eaves trough with a controlled amount of water and cleaning solution flowing from the fluid flow mechanism and exiting the cleaning tool into the eaves trough.

Lastly, it is an object of the present invention to provide a new and improved eaves trough cleaner including a fluid flow mechanism. The fluid flow mechanism has a top end and a bottom end and an intermediate portion with a cross tubing integral therewith. The cross tubing has an internal fluid passage and a second end with a container coupled. The internal passage has a vertical extension coupled to an elongated tube positionable within the container. Included is a trigger mechanism with a regulator valve coupled to the intermediate portion and spaced from the cross tubing. Also, a cleaning tool is provided. Lastly, at least one connector pipe member is included. The one connector pipe member has an upper end and a bottom end. The bottom end of the pipe member couples with the fluid flow mechanism. The upper end of the pipe member couples with the cleaning tool for placement of the cleaning tool within the eaves trough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
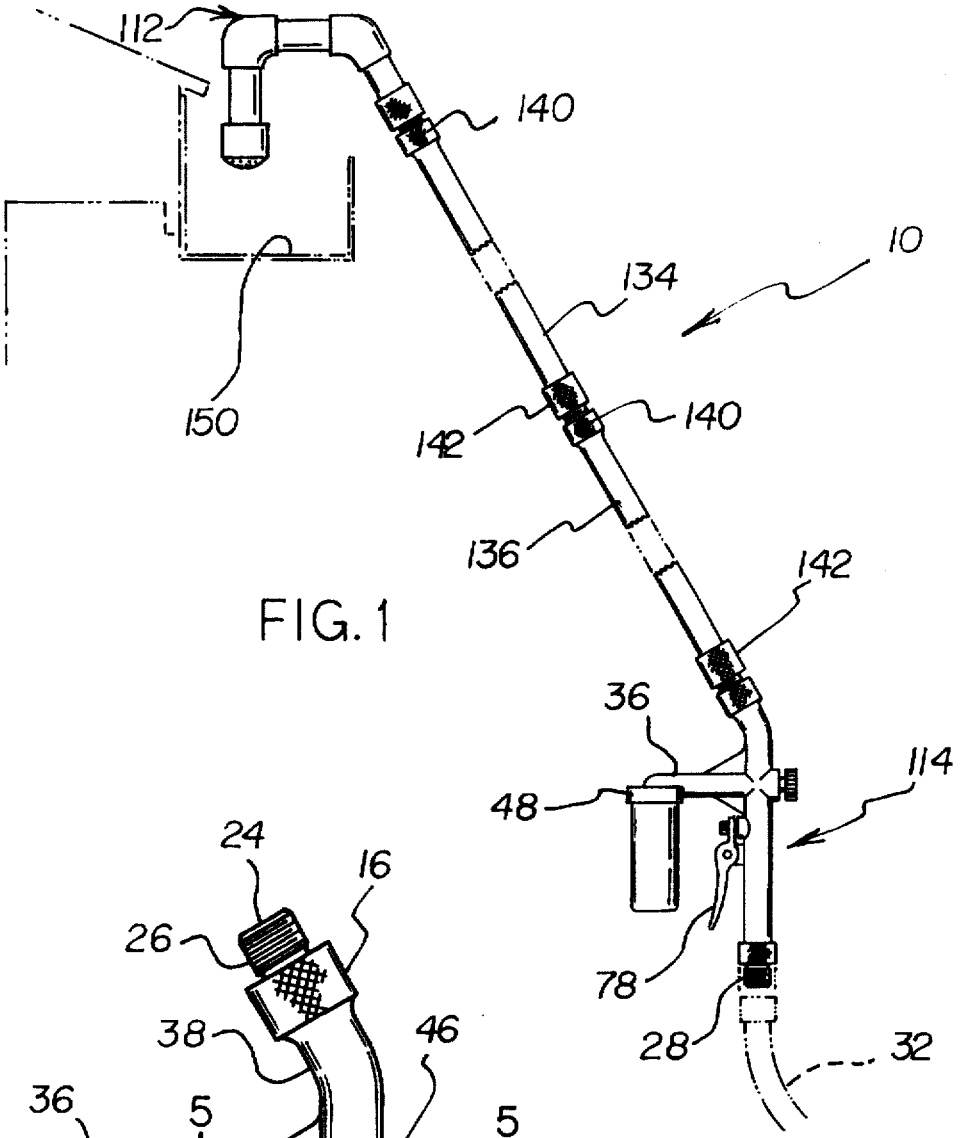
FIG. 1 is a perspective view of the preferred embodiment of the eaves trough cleaner constructed in accordance with the principles of the present invention.

With reference now to the drawings, and in particular to FIG. 1 thereof, the preferred embodiment of the new and improved eaves trough cleaner embodying the principles and concepts of the present invention and generally designated by the reference numeral 10 will be described.

The present invention, the eaves trough cleaner 10 is comprised of a plurality of components. Such components in their broadest context include a fluid flow mechanism, a pair of connector pipes, and a cleaning tool. Such components are individually configured and correlated with respect to each other so as to attain the desired objective.

Figure 2:
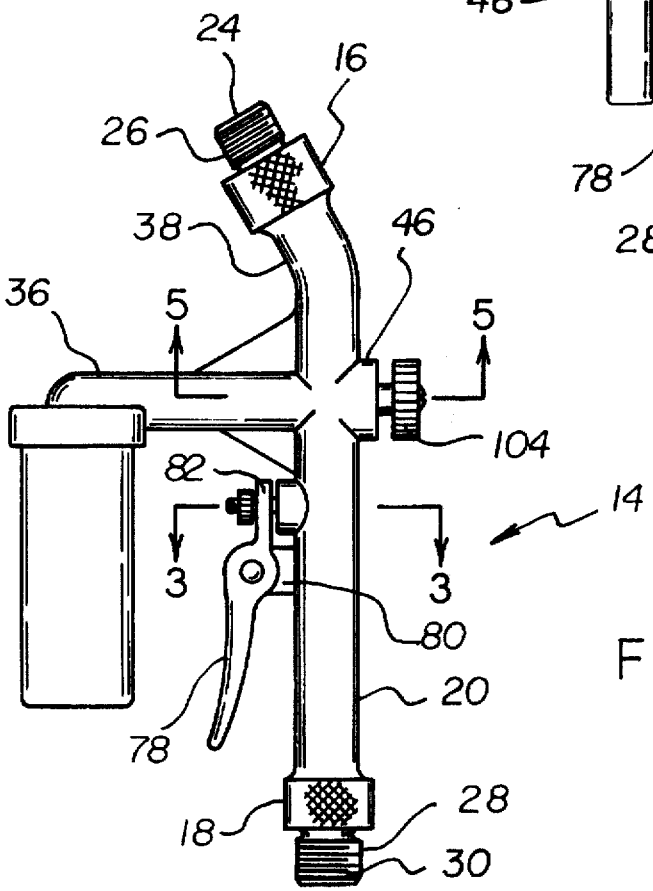
FIG. 2 is an enlarged side view of the fluid flow mechanism of the present invention.
Figure 4:
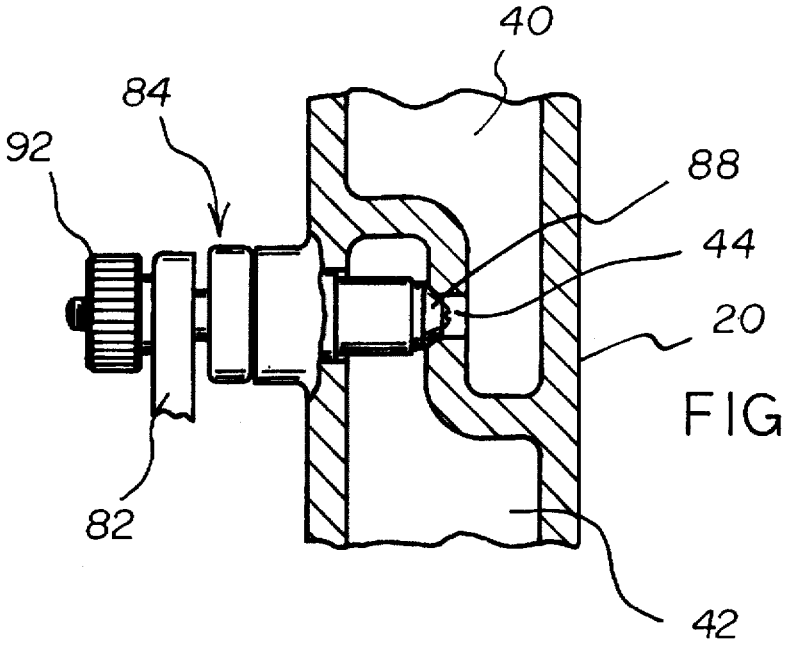
FIG. 4 is a cross-sectional view of the regulator valve taken along line 4—4 of FIG. 3.

Specifically, the present invention includes a fluid flow mechanism 14. The fluid flow mechanism is a pipe that has a top end 16, a bottom end 18 and an intermediate portion 20 therebetween. The fluid flow mechanism, as shown in FIG. 2, is formed of a rigid material, preferably a metal or metal alloy. The top end has a top connector 24 with threads 26. The bottom end has a bottom connector 28 with threads 30 for coupling with a hose 32, as seen in FIG. 1. The intermediate portion has a cross tubing 36 integral therewith and a bend 38 near the top end. The cross tubing is spaced from the bend near the top end. The fluid flow mechanism, as depicted in FIG. 4, has an upper fluid chamber 40, a lower fluid chamber 42 and an opening 44 between the chambers.

Figure 5:
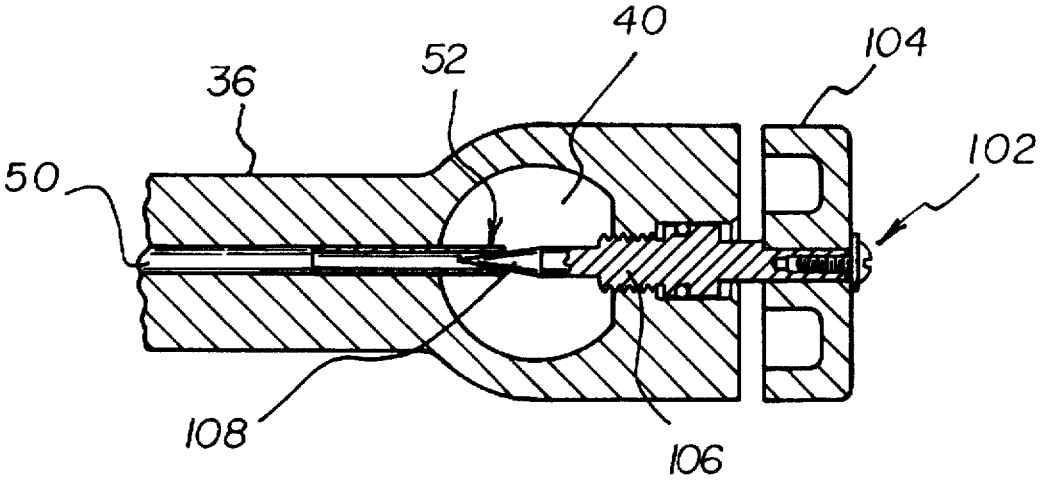
FIG. 5 is a cross sectional view of the turn valve taken along line 5—5 of FIG. 2.
Figure 6:
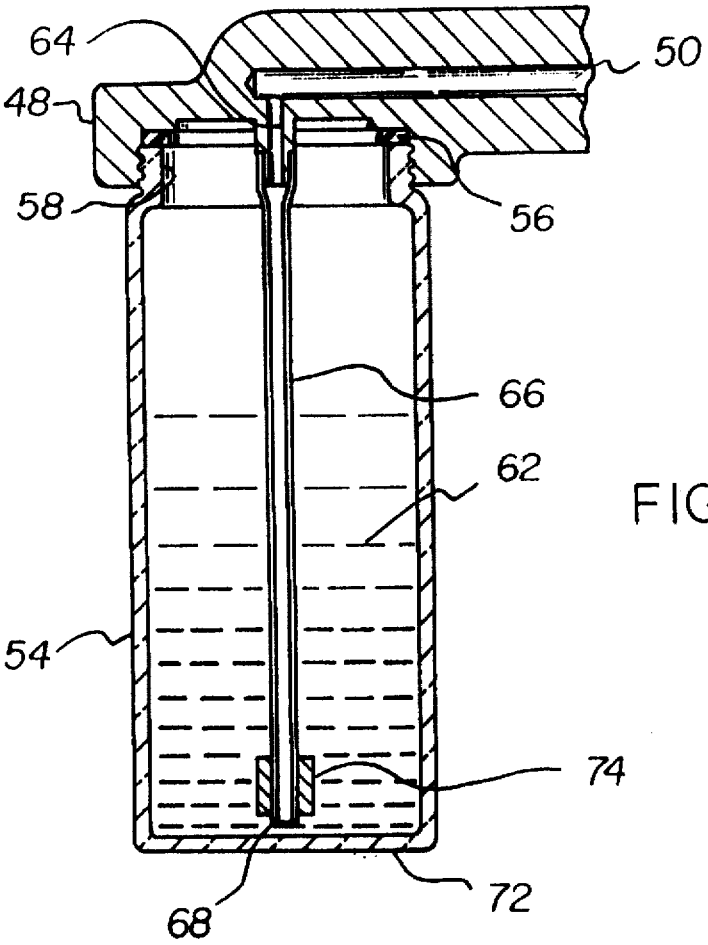
FIG. 6 is a cross sectional view of the container and cross tubing of the present invention of FIG. 1.

The cross tubing has a first end 46, a second end 48 and an internal fluid passage 50 therebetween, as seen in FIG. 6. The internal passage, as shown in FIG. 5, has an internal portion 52 projecting into the upper chamber 40 of the intermediate portion. The second end of the cross tubing has a container 54 releasably coupled thereto.

A gasket 56 is positioned between the top 58 of the container and the second end of the cross tubing. The gasket ensures an air tight seal when the container and the second end of the cross tubing are coupled together. The container holds a cleaning solution 62. The internal passage has a vertical extension 64 at the second end of the cross tubing. The extension is coupled with an elongated flexible tube 66 that is positioned within the container. The flexible tube will carry the cleaning solution up and into the internal passage for release into the fluid flow mechanism. The flexible tube has a lower end 68 spaced from the bottom 72 of the container. The lower end has a weight 74 for retaining the position of the flexible tube when the container is held in various orientations.

A best illustrated in FIG. 1, a trigger mechanism 78 is coupled with the intermediate portion 20. The trigger mechanism is positioned between the cross tubing 36 and the bottom end, with a support bracket 80 pivotally supporting the trigger mechanism. The trigger mechanism has a lever portion 82 that engages a regulator valve 84. The regulator valve has a front portion structure 88 for reception within a valve seat 90 within opening 44 of the intermediate portion. The regulator valve having a rear portion 92 that is engaged by the lever of the trigger mechanism, as seen in FIG. 4.

Figure 3:
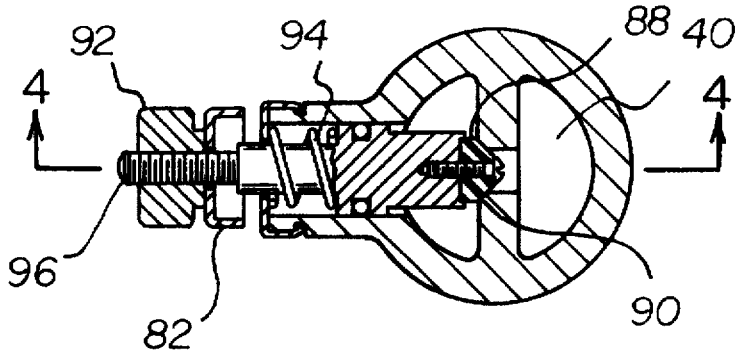
FIG. 3 is cross sectional view of the regulator valve taken along line 3—3 of FIG. 2.

The regulator valve further including a resilient member 94 for urging the regulator valve into engagement with the valve seat for sealing the opening within the fluid flow mechanism. The resilient member is a spring that wraps around the rod 96 of the regulator valve, as seen in FIG. 3.

The regulator valve is capable of axial movement for controlling water flow through the chambers of the fluid flow mechanism. When the trigger mechanism is pivoted, for urging the regulator valve, water is allowed to flow between the chambers of the intermediate portion.

Also, a turn valve mechanism 102 is provided. As seen in FIG. 5, the turn valve mechanism is positioned within the first end of the cross tubing 36. The turn valve mechanism has a turn knob 104 secured to a plunger member 106. The plunger member has a head 108 for rotatable placement within the internal portion 52 of the internal passage for sealing and unsealing the passage. The turn knob allows the turn valve to open and close the internal portion for release of the cleaning solution as the water flows through the fluid flow mechanism.

Figure 7:
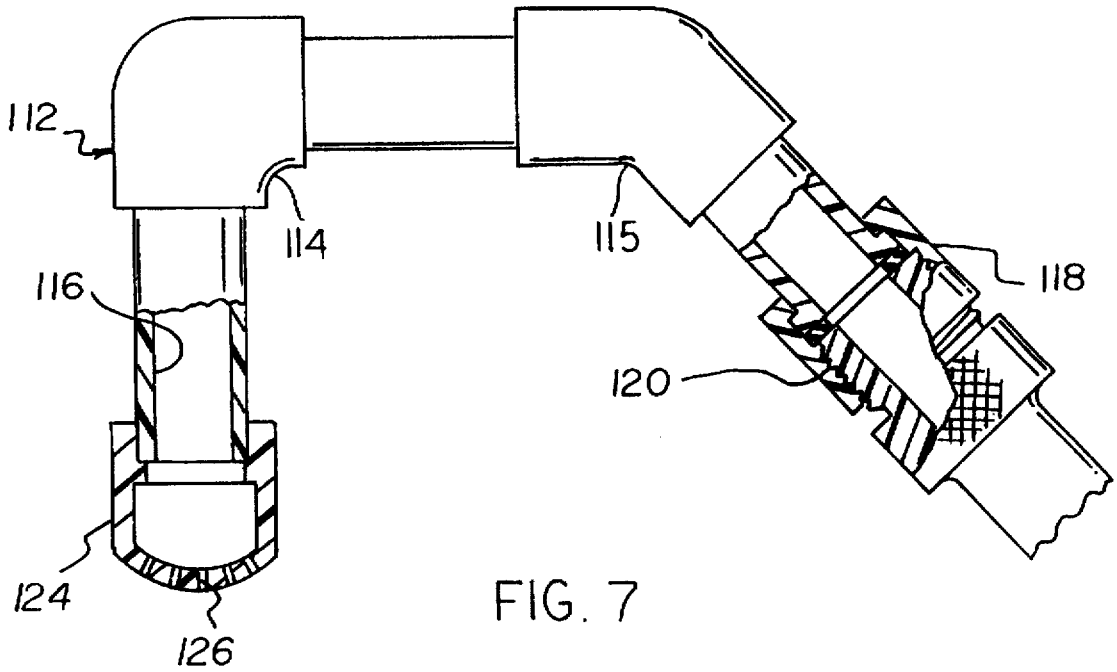
FIG. 7 is an enlarged view of the J-hook structured cleaning tool in an operable configuration.
Figure 8:
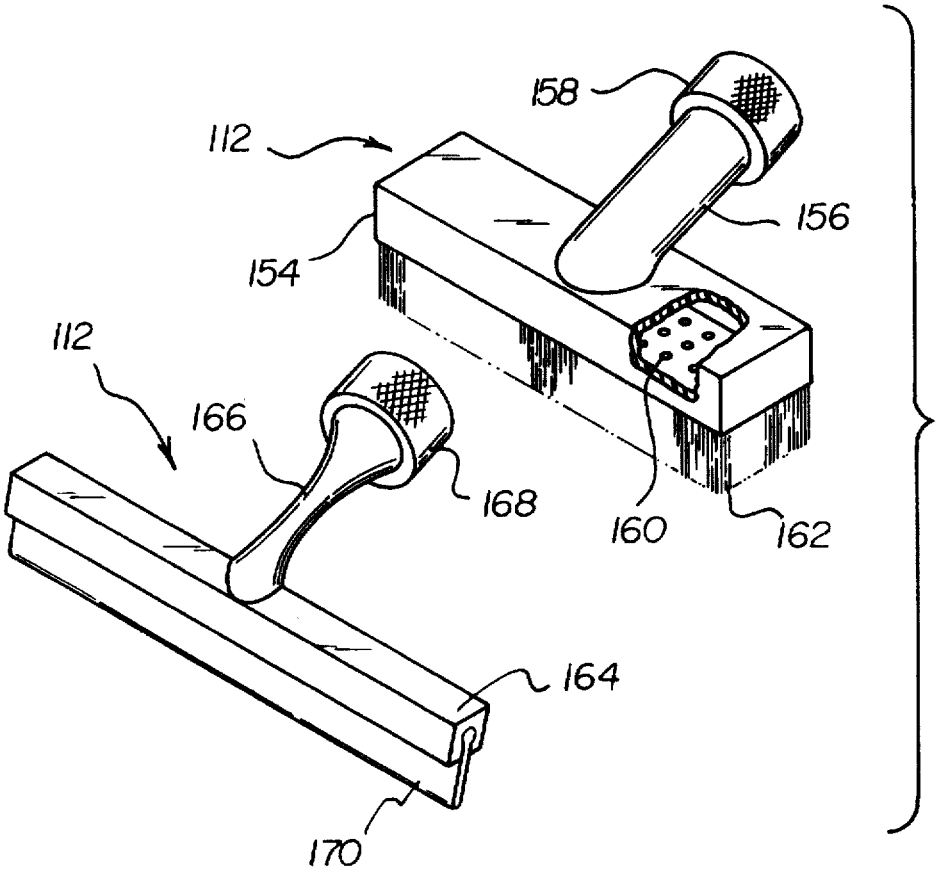
FIG. 8 is an isometric view of alternative embodiments of the cleaning tool invention of FIG. 1.

Additionally, a cleaning tool 112 is included. The cleaning tool is an interchangeable device. In FIG. 1, the cleaning tool is a generally J-hook structure that has a 90° bend 114, a 60° bend 115, a fluid release end 116 and a coupling end 118. FIG. 7 shows the coupling end with an internal threaded portion 120. The J-hook structure cleaning tool has a nozzle 124, with a plurality of holes 126, attached to the fluid release end.

Figure 9:
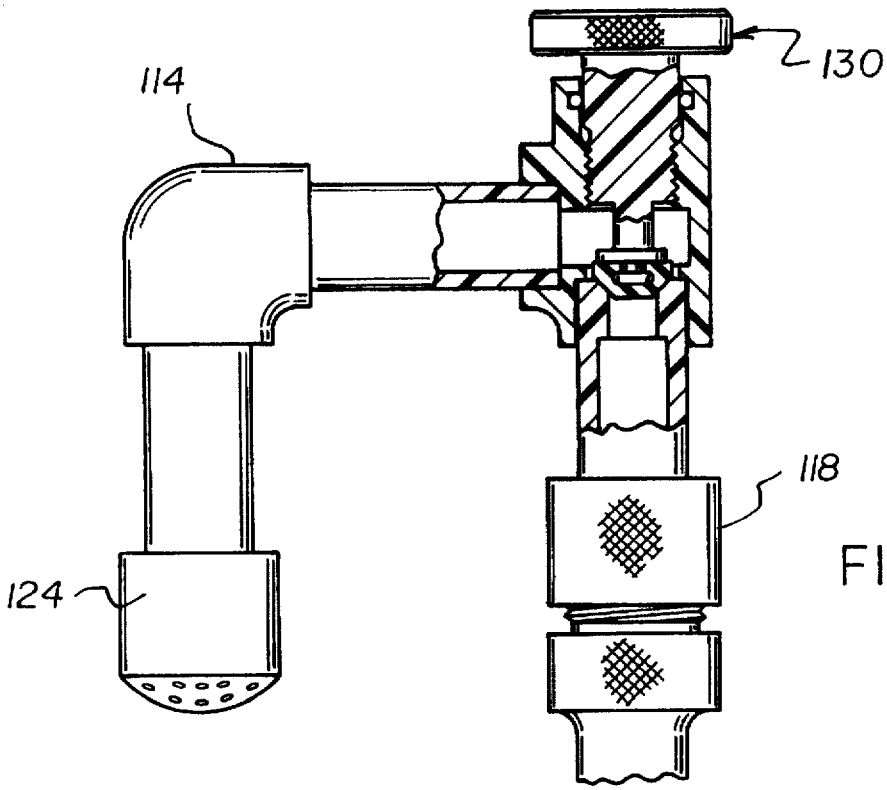
FIG. 9 is a cross sectional view a U-shape structured cleaning tool with a flow control valve in an operable configuration.
Figure 10:
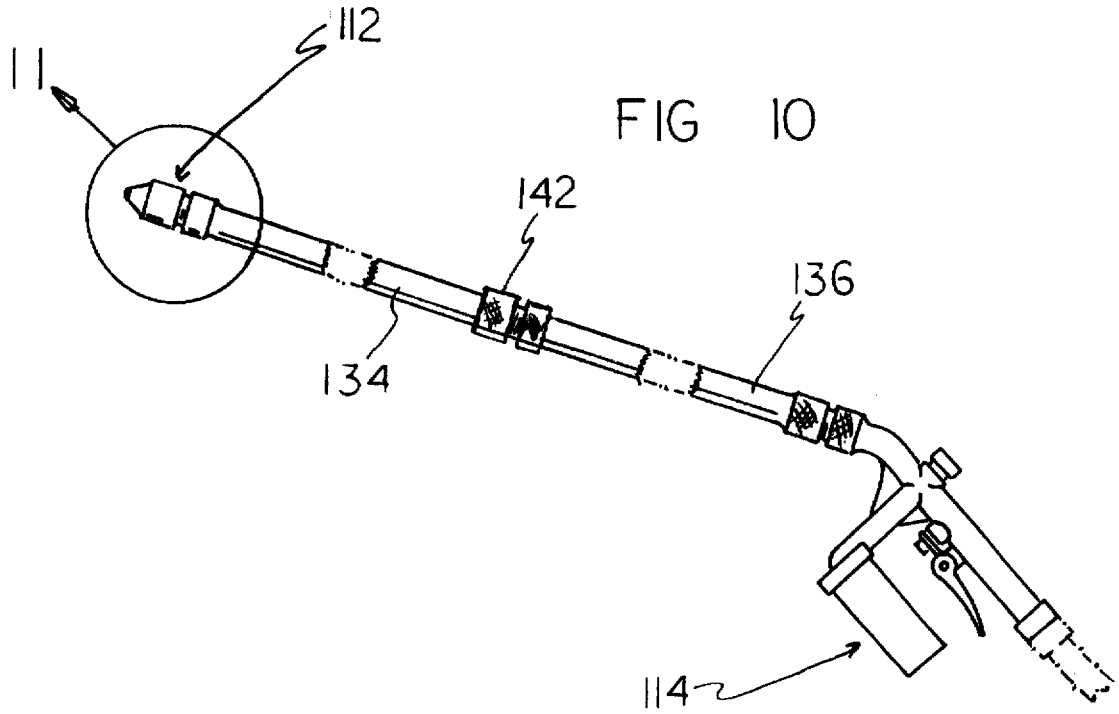
FIG. 10 is an isometric view of the cleaning tool as a spray nozzle in an operable configuration.
Figure 11:
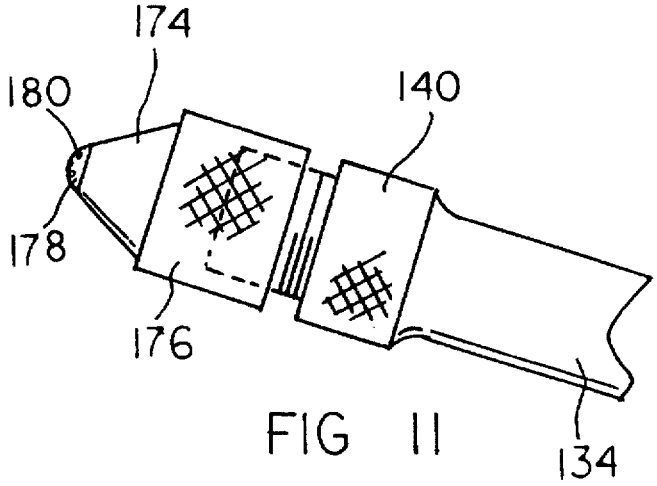
FIG. 11 is an enlarged view of the spray nozzle of FIG. 10.

As shown in FIG. 9, the cleaning tool may be U-shaped and structured to include a flow control valve 130. The U-shaped structure is identical to the J-hook structure, in that it has a fluid release end 116 with a nozzle 124 and a coupling end 118. The main difference in the structures is that the 60° bend has been replaced with the flow control valve and its components. The flow control valve would be attached to the U-shaped cleaning tool near the coupling end 118. The flow control valve would be used to regulate the rate of water to be released from the nozzle.

Lastly, a pair of elongated connector pipes 134 and 136 are used to couple the cleaning tool and the fluid flow mechanism 14. Each pipe has an upper end 140 and a bottom end 142. The pair of pipes form a first pipe member 134 and a second pipe member 136. As seen in FIG. 1, the bottom end of the first pipe member is releasablly coupled with the upper end of the second pipe member. The upper end of the first pipe couples with the coupling end 118 of the J-hook structure cleaning tool to allow placement of the cleaning tool within the eaves trough 150. The bottom end of the second pipe member couples with the top end of the fluid flow mechanism 14, when the first pipe is coupled to the cleaning tool. Whereby, when the fluid flow mechanism is coupled to the hose the trigger mechanism allows water to flow through the pair of elongated connector pipes. The water is then released through the nozzle of the J-hook structure cleaning tool within the eaves trough.

The present invention is functional with the J-hook cleaning tool and the U-shaped cleaning tool. The J-hook structure is the preferred embodiment for cleaning eaves trough. The 60° bend of the J-hook cleaning tool, above the coupling end, provides an easier placement of the cleaning tool in the eaves trough. Also, the J-hook cleaning tool, when positioned in the eaves trough will prevent a backward spray of liquid from coming in contact with the user.

It should be understood that the present invention is functional with at least one pipe. The one pipe could be either the first pipe member or the second pipe member. The one pipe would couple with the cleaning tool at the upper end and the fluid flow mechanism at the lower end.

Furthermore, the cleaning tool of the present invention is not limited to the J-hook structure and the U-shaped cleaning tools. The cleaning tool includes other interchangeable attachments. In one instance the cleaning tool may be a brush mechanism that has a rectangular member 154 extending from a fluid tube 156. The fluid tube has having a coupling end 158 for engaging the upper end 140 of one of the connector pipe members. The rectangular member has a plurality of holes 160 therethrough. The holes allow the release of water, flowing from the fluid flow mechanism 14, between the bristles 162 of the brush.

Another cleaning tool attachment is a squeegee mechanism. The squeegee mechanism has a rectangular holder 164 that extends from a fluid tube 166. The fluid tube has a coupling end 168 for engaging the upper end 140 of the one connector pipe member. The rectangular holder has a flexible member 170 coupled within. Not shown in an opening at the rear of the rectangular holder for release of the water flowing through the fluid tube of the squeegee.

Finally, one other cleaning tool attachment is a spray nozzle. The spray nozzle has a head member 174 and a coupling portion 176. The head member is cone shaped and has a tip 178 with a plurality of holes 180. The coupling portion is threadedly coupled to the upper end 140 of the first connector pipe member 134. The holes allow the liquid mixture of water and cleaning solution, under pressure, to be used to wash various objects. These objects, to name a few, may be a house, a car, a sidewalk and a truck.

The present invention the improved eaves trough cleaner is an easy-to-use "wand" designed tool. The eaves trough cleaner will enable the homewoner to clean out eaves trough (rain gutters) with the use of water pressure. The present invention is made out of ½ inch polyvinyl chloride tubing in 4 foot connectable sections. The fluid flow mechanism is structured to be attached to a standard garden hose. The fluid flow mechanism has a series of valves. One of the valves, the regulator valve allows the user to adjust the water pressure. Another of the valves will allow the user to control the flow of cleaning solution, from a container coupled to the cross tubing, into the fluid chambers of the fluid flow mechanism. The present invention includes a variety of interchangeable cleaning tools. These tools include a J-hook structure, U-shaped cleaning tool, a brush, a squeegee, and a spray nozzle. Each tool couples to the connectable section and allows water to be release.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved eaves trough cleaner for removal of debris from rain gutters comprising in combination:

a fluid flow mechanism having a top end and a bottom end and an intermediate portion therebetween, the top end having a top connector being threaded and the bottom end having a bottom connector being threaded for coupling with a hose, the intermediate portion having a cross tubing integral therewith and spaced from the top end, the cross tubing having a first end, a second end and an internal fluid passage therebetween, the second end of the cross tubing having a container coupled thereto, a gasket being positioned between the top of the container and the second end of the cross tubing, the internal passage having a vertical extension at the second end of the cross tubing, the extension being coupled with an elongated flexible tube positioned within the container, the flexible tube having a lower end with a weight for retaining the position of the flexible tube when the container is held in various orientations;

a trigger mechanism being coupled with the intermediate portion and positioned between the cross tubing and the bottom end, the trigger mechanism has a support bracket pivotally supporting the trigger mechanism, the trigger mechanism has a lever portion that engages a regulator valve, the regulator valve has a front portion structure for reception within a valve seat within the opening of the intermediate portion, the regulator valve having a rear portion being engaged by the lever of the trigger mechanism, the regulator valve having a resilient member for urging the regulator valve into engagement with the valve seat for sealing the opening within the fluid flow mechanism, the regulator valve controlling water flow through the fluid flow mechanism when the trigger mechanism being pivoted about the support bracket for urging the regulator valve;

a turn valve mechanism being positioned within the first end of the cross tubing for sealing and unsealing the internal passage thereof;

a cleaning tool having a a U-shape and including a flow control valve and having a fluid release end and a coupling end with an internal threaded portion, the cleaning tool having a nozzle with a plurality of holes being attached to the fluid release end; and a pair of elongated connector pipes with each pipe having an upper end and a bottom end, the pair of pipes forming a first pipe member and a second pipe member, the bottom end of the first pipe member being releasable coupled with the upper end of the second pipe member, the upper end of the first pipe coupling with the coupling end of the cleaning tool for allowing the cleaning tool to be placed within the eaves trough, the bottom end of the second pipe member coupling with the top end of the fluid flow mechanism when the first pipe being coupled to the cleaning tool, whereby when the fluid flow mechanism being coupled to the hose the trigger mechanism allows water to flow through the pair of elongated connector pipes for release through the nozzle of the cleaning tool within the eaves trough.

* * * * *